US008761633B2

(12) United States Patent
Souda

(10) Patent No.: US 8,761,633 B2
(45) Date of Patent: Jun. 24, 2014

(54) IMAGE FORMING APPARATUS

(75) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 133 days.

(21) Appl. No.: 13/420,016

(22) Filed: Mar. 14, 2012

(65) Prior Publication Data

US 2012/0237256 A1 Sep. 20, 2012

(30) Foreign Application Priority Data

Mar. 16, 2011 (JP) ..... 2011-058462

(51) Int. Cl.
*G03G 21/16* (2006.01)

(52) U.S. Cl.
USPC ..... 399/111; 399/116

(58) Field of Classification Search
USPC ..... 399/111, 116
See application file for complete search history.

(56) References Cited

U.S. PATENT DOCUMENTS

| | | | | |
|---|---|---|---|---|
| 7,720,411 | B2 | 5/2010 | Itabashi | |
| 7,840,159 | B2 * | 11/2010 | Nakashima | 399/117 |
| 8,000,628 | B2 | 8/2011 | Sato et al. | |
| 2008/0219696 | A1 | 9/2008 | Itabashi | |
| 2009/0142092 | A1 | 6/2009 | Sato | |
| 2009/0226205 | A1 | 9/2009 | Sato et al. | |
| 2010/0074649 | A1 | 3/2010 | Kondo | |
| 2010/0247139 | A1 * | 9/2010 | Wu et al. | 399/111 |

FOREIGN PATENT DOCUMENTS

| | | | | |
|---|---|---|---|---|
| JP | 10-142883 | | 5/1998 | |
| JP | 2004-109455 | A | 4/2004 | |
| JP | 2004109455 | A * | 4/2004 | G03G 21/16 |
| JP | 2007-072479 | | 3/2007 | |
| JP | 2008-090121 | A | 4/2008 | |
| JP | 2008-224837 | | 9/2008 | |
| JP | 2009-157135 | | 7/2009 | |
| JP | 2009-210937 | A | 9/2009 | |
| JP | 2010-072587 | | 4/2010 | |

OTHER PUBLICATIONS

Sanpei. JP200109455A Machine Translation. Published Apr. 2004. Translated Sep. 2013.*
JP Office Action mailed Mar. 12, 2013, JP Appln. 2011-058462, English translation.

* cited by examiner

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

An image forming apparatus includes a casing, photosensitive members arranged along an arrangement direction, and developing cartridges. Each developing cartridge includes a developer carrying member configured to supply a developer to a corresponding one of the photosensitive members. Each photosensitive member is configured to move between an image formation position where an image is formed on the photosensitive member and a retracted position where the photosensitive member is retracted from the developer carrying member. When the photosensitive member is in the image formation position, the photosensitive member is configured to close a path through which a corresponding one of the developing cartridges is attached to and removed from the casing. When the photosensitive member is in the retracted position, the photosensitive member is configured to open the path.

20 Claims, 10 Drawing Sheets

IMAGE FORMING APPARATUS

CROSS REFERENCE TO RELATED APPLICATION

This application claims priority from Japanese Patent Application No. 2011-058462, filed on Mar. 16, 2011, the entire subject matter of which is incorporated herein by reference.

FIELD

Aspects of the disclosure relate to an electrophotographic image forming apparatus.

BACKGROUND

As an electrophotographic image forming apparatus, a color printer is known which includes four photosensitive drums for four colors, yellow, magenta, cyan, and black.

A color multifunction apparatus, which is proposed as an example of the color printer, may include process cartridges for each color, a support frame, an intermediate transfer belt and a secondary transfer roller. Each of the process cartridges may include a photosensitive drum and a developing unit. The developing unit may include a developing roller, a first supply roller, a second supply roller, a doctor blade, and a toner container. The support frame may be configured to integrally support the process cartridges arranged therein and to be pulled out toward a front side. The intermediate transfer belt may extend horizontally such as to contact the photosensitive drums from above. The secondary transfer roller may be disposed such as to contact the intermediate transfer belt from one horizontal direction.

In the above color multifunction apparatus, each process cartridge is detachably attachable to the support frame when the support frame is pulled out from the main casing toward the front side.

Each process cartridge may integrally include the photosensitive drum and the developing unit.

Typically, the photosensitive drum needs replacing with less frequency than toner refill. Thus, the demand to replace the developing unit only, without having to replace the photosensitive drum, is growing.

However, the photosensitive drum is supported by an upper end of the process cartridge and the developing unit is disposed under the photosensitive drum in the color multifunction apparatus.

Thus, it is difficult to move the developing unit only from or to the support frame up and down.

SUMMARY

Illustrative aspects of the disclosure provide an image forming apparatus including a casing, a photosensitive drum disposed in the casing, and a developing cartridge facing the photosensitive drum, the image forming apparatus being configured to facilitate attachment and removal of the developing cartridge to and from the casing.

BRIEF DESCRIPTION OF THE DRAWINGS

Illustrative aspects will be described in detail with reference to the following figures in which like elements are labeled with like numbers and in which:

FIGS. 5A and 5B illustrate an LED cover is interlocked with attachment and removal of a developing cartridge, wherein FIG. 5A is an enlarged sectional view in which a developing cartridge is attached and an LED cover is located in an open position, and FIG. 5B is an enlarged sectional view in which the developing cartridge is removed and the LED cover is located in a closed position;

FIGS. 6A and 6B illustrate that the LED cover is interlocked with the attachment and removal of the developing cartridge, wherein FIG. 6A is a sectional view of the process unit as viewed from a front side, illustrating that the developing cartridge is attached and the LED cover is in the closed position, and FIG. 6B is a sectional view of the process unit as viewed from the front side, illustrating that the developing cartridge is removed and the LED cover is in the open position;

FIGS. 7A and 7B illustrate a printer according to a second embodiment, wherein FIG. 7A illustrates that the developing cartridge is attached and the LED cover is in the open position, and FIG. 7B illustrates that the developing cartridge is removed and the LED cover is in the closed position;

DETAILED DESCRIPTION

A first illustrative embodiment will be described in detail with reference to the accompanying drawings.

Figure 1:
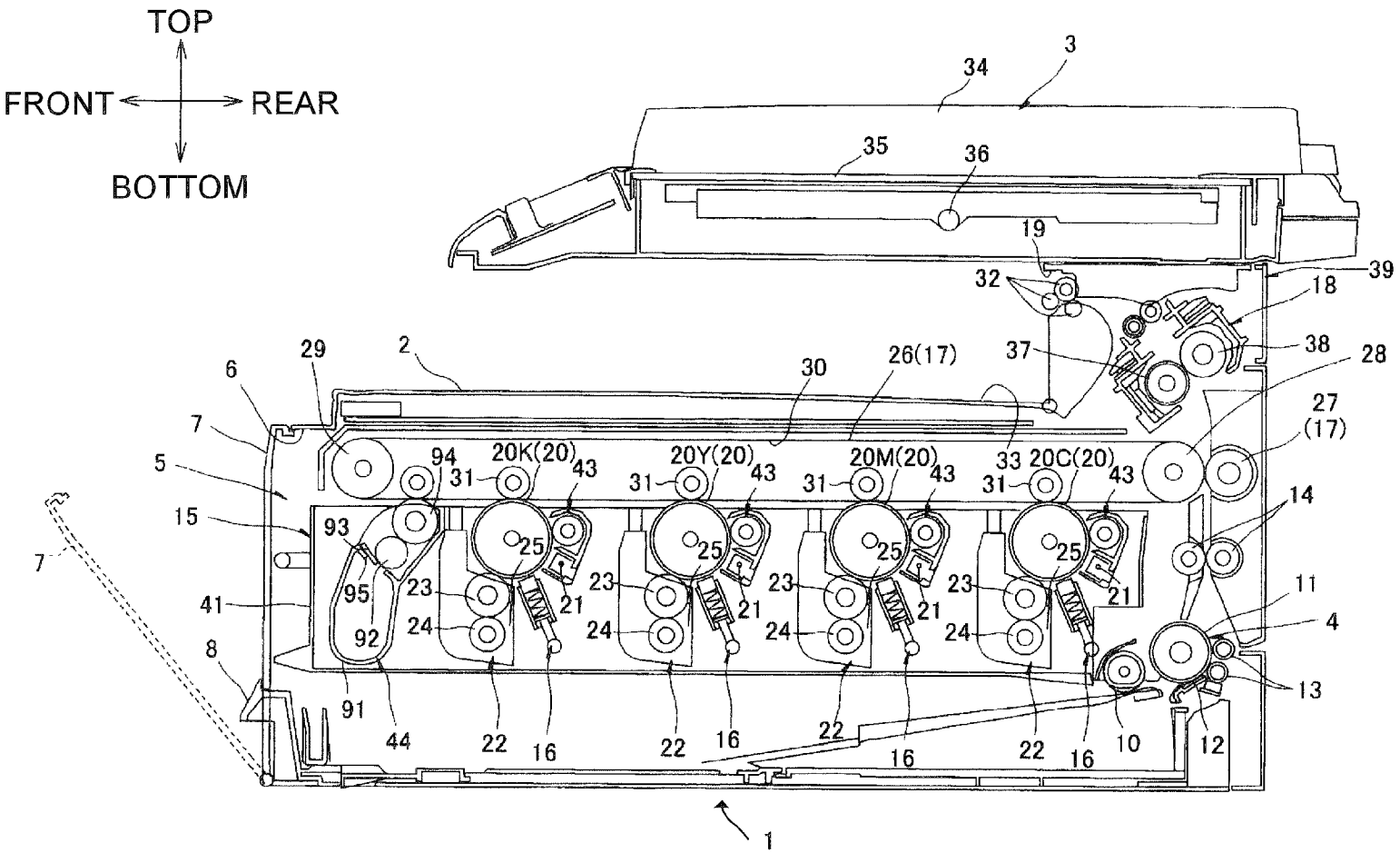
FIG. 1 is a side sectional view of an illustrative image forming apparatus, e.g. a printer, according to a first embodiment.

As shown in FIG. 1, an image forming apparatus according to aspects of the invention applies to a printer 1, which is horizontally oriented and is of an intermediate transfer type.

The printer 1 is a multifunction apparatus integrally including a casing 2 as an example of a main body, and a flat bed scanner 3, which is disposed above the casing 2 and configured to read image formation of a document.

The printer 1 may further include a sheet supply section 4 configured to supply a sheet P and an image forming section 5 configured to form an image on the sheet P supplied from the sheet supply section 4.

The casing 2 is box-shaped to have the form of substantially a rectangle in a side view and accommodates the sheet supply section 4 and the image forming section 5 therein. One side wall of the casing 2 contains an opening 6 and a front cover 7 configured to pivot on its lower end portion between a closed position (FIG. 1) to close the opening 6 and an open position (FIG. 3) to open the opening 6.

In the following descriptions, the side on which the front cover 7 is provided (the left side of FIG. 1) is referred to as the front or front side, and the opposite side (the right side of FIG.

1) is referred to as the rear or rear side. The left or left side and the right or right side are defined when the printer 1 is viewed from the front side.

The sheet supply section 4 may include a sheet supply tray 8 configured to store stack of sheets P therein. The sheet supply tray 8 may be disposed in a lower portion of the casing 2 and non-destructively detachable from and attachable to the casing 2.

The sheet supply section 4 may include a pickup roller 10, a sheet supply roller 11, a sheet supply pad 12, a pair of pinch rollers 13, and a pair of registration rollers 14. The pickup roller 10 is disposed in an upper rear portion of the sheet supply tray 8. The sheet supply roller 11 is disposed behind the pickup roller 10. The sheet supply pad 12 is disposed facing the sheet supply roller 11 from below. The pinch rollers 13 are arranged one above the other and contact the sheet supply roller 11 from the rear side. The registration rollers 14 are disposed facing each other in a front-rear direction above the sheet supply roller 11.

The sheets P in the sheet supply tray 8 are fed between the sheet supply roller 11 and the sheet supply pad 12 by rotation of the pickup roller 10, and separated one by one by rotation of the sheet supply roller 11. By rotation of the sheet supply roller 11, a separated sheet P passes between the sheet supply roller 11 and the pinch rollers 13, and is fed to the registration rollers 14. By rotation of the registration rollers 14, the sheet P is supplied to the image forming section 5 (specifically, between an intermediate transfer belt 13 and a secondary transfer roller 27) at a specified time.

The image forming section 5 is disposed above the sheet supply section 4, and includes a process unit 15 as an example of a movable unit, four light emitting diode (LED) units 16 as an example of an exposure member, a transfer unit 17, and a fixing unit 18.

The process unit 15 is disposed facing the sheet supply tray 8 from above, in front of the pickup roller 10 such as to overlap the pickup roller 10 when projected in the front-rear direction. The process unit 15 is configured to move, e.g., slide, along the front-rear direction between an inside position (FIG. 1) where the process unit 15 is located inside the casing 2 and an outside position (FIG. 3) where the process unit 15 is pulled out from and located outside the casing 2.

When the process unit 15 is in the inside position, an intermediate transfer belt 30 and photosensitive drums 20 are disposed in a first relative position where they are disposed proximate to each other. When the process unit 15 is in the outside position, the intermediate transfer belt 30 and the photosensitive drums 20 are disposed in a second relative position where they are separated from each other.

The process unit 15 is configured to accommodate four photosensitive members, e.g., photosensitive drums 20, provided for each color, four scorotron chargers 21 corresponding to the photosensitive drums 20, and four developing units, e.g., developing cartridges 22, corresponding to the photosensitive drums 20 therein.

Each of the photosensitive drums 20 has substantially a cylindrical shape, which extends in the left-right direction, and is disposed along the left-right direction. The photosensitive drums 20 are arranged in the front-rear direction. Specifically, a black photosensitive drum 20K, a yellow photosensitive drum 20Y, a magenta photosensitive drum 20M, and a cyan photosensitive drum 20C are arranged in this order from the front to the rear.

Each of the scorotron chargers 21 is disposed at the rear of and spaced apart from a corresponding one of the photosensitive drums 20.

Each of the developing cartridges 22 is disposed at a lower front side of a corresponding one of the photosensitive drums 20. The developing cartridges 22 are arranged in the front-rear direction. Each of the developing cartridges 22 includes a developer carrying member, e.g. a developing roller 23.

Each developing roller 23 is rotatably supported in an upper end of a corresponding developing cartridge 22 such that the developing roller 23 is exposed from above and contacts a corresponding photosensitive drum 20 from below.

Each developing cartridge 22 includes a supply roller 24 configured to supply toner to the developing roller 23, and a layer-thickness regulating blade 25 configured to regulate a thickness of toner supplied to the developing roller 23. Each developing cartridge 22 contains a developer, e.g. toner of each color, in front of the supply roller 24.

Each of the LED units 16 is disposed at the rear of a corresponding developing cartridge 22 so as to face a corresponding photosensitive drum 20 from below. Each LED unit 16 is configured to expose a surface of its corresponding photosensitive drum 20 based on image data and form a latent image on the surface.

The transfer unit 17 may include a belt unit 26 and a secondary transfer roller 27.

The belt unit 26 may be disposed above the process unit 15 along the front-rear direction so as to face the photosensitive drums 20 from above.

The belt unit 26 may include a drive roller 28, a driven roller 29, an endless belt, e.g. an intermediate transfer belt 30, and four primary transfer rollers 31.

The drive roller 28 and the driven roller 29 are spaced apart from each other in the front-rear direction.

The intermediate transfer belt 30 is looped around the drive roller 28 and the driven roller 29 and disposed such that a lower side of the intermediate transfer belt 30 contacts the photosensitive drums 20. The intermediate transfer belt 30 is configured to rotate upon rotation of the drive roller 28 in such a direction that the lower side contacting the photosensitive drums 20 moves from front to rear.

The primary transfer rollers 31 are disposed within the intermediate transfer belt 30 and above the respective photosensitive drums 20 such that the lower side of the intermediate transfer belt 30 is sandwiched between the primary transfer rollers 31 and the photosensitive drums 20.

The secondary transfer roller 27 is disposed at the rear of the intermediate transfer belt 30 such that the intermediate transfer belt 30 is sandwiched between the secondary transfer roller 27 and the drive roller 28 of the belt unit 26.

The fixing unit 18 is disposed above the secondary transfer roller 27, and includes a heat roller 37 and a pressure roller 38 disposed facing the heat roller 37.

In each developing cartridge 22, toner is supplied to the supply roller 24 and then supplied from the supply roller 24 to the developing roller 23.

Toner supplied to the developing roller 23 is positively charged between the supply roller 24 and the developing roller 23 by friction with rotation of the developing roller 23, regulated to a specified thickness by the layer-thickness regulating blade 25 and then carried on a surface of the developing roller 23 as a thin layer.

The surface of the photosensitive drum 20 is uniformly and positively charged by the scorotron charger 21 along with rotation of the photosensitive drum 20, and then exposed by the LED unit 16. Thus, a latent image corresponding to an image to be formed on a sheet P is formed on the surface of the photosensitive drum 20.

When the photosensitive drum 20 further rotates, positively charged toner carried on the surface of the developing roller 23 is supplied to the latent image formed on the surface of the photosensitive drum 20. With this, the latent image on the photosensitive drum 20 is visualized, and a toner image is carried on the surface of the photosensitive drum 20 by reversal developing. In this manner, toner images are carried on the surfaces of the photosensitive drums 20.

The toner images carried on the surfaces of the photosensitive drums 20 by reversal developing are primarily transferred to the lower side of the intermediate transfer belt 30 moving from the front to the rear. The toner images are sequentially overlapped one over the other to form a color image on the intermediate transfer belt 30.

The color image formed on the intermediate transfer belt 30 is secondarily transferred to a sheet P supplied from the sheet supply section 4 when the color image formed on the intermediate transfer belt 30 passes a position facing the secondary transfer roller 27.

The color image transferred to the sheet P is fixed at the fixing unit 18 while the sheet P passes between the heat roller 37 and the pressure roller 38.

A top surface of the casing 2 contains an ejection tray 33 to which the sheet P is to be ejected. An upper rear end portion of the casing 2 protrudes upward from the ejection tray 33 and contains an ejection portion 39.

The ejection portion 39 has an ejection opening 19 formed above the ejection tray 33. The sheet P is ejected from the ejection opening 19. The ejection portion 39 includes a plurality of, e.g., three, ejection rollers 32 disposed in the ejection opening 19 and configured to feed the sheet P to the ejection tray 33.

The sheet P having the toner image fixed at the fixing unit 18 is ejected onto the ejection tray 33 by the ejection rollers 32.

The flatbed scanner 3 is spaced from and above the ejection tray 33 and supported at an upper end portion of the ejection tray 39. In the flatbed scanner 3, a document is placed between a pressing cover 34 and a glass surface 35, and then a CCD sensor 36 slides to read image information of the document.

As shown in FIG. 1, the process unit 15 includes a drawer frame 41.

Figure 2:
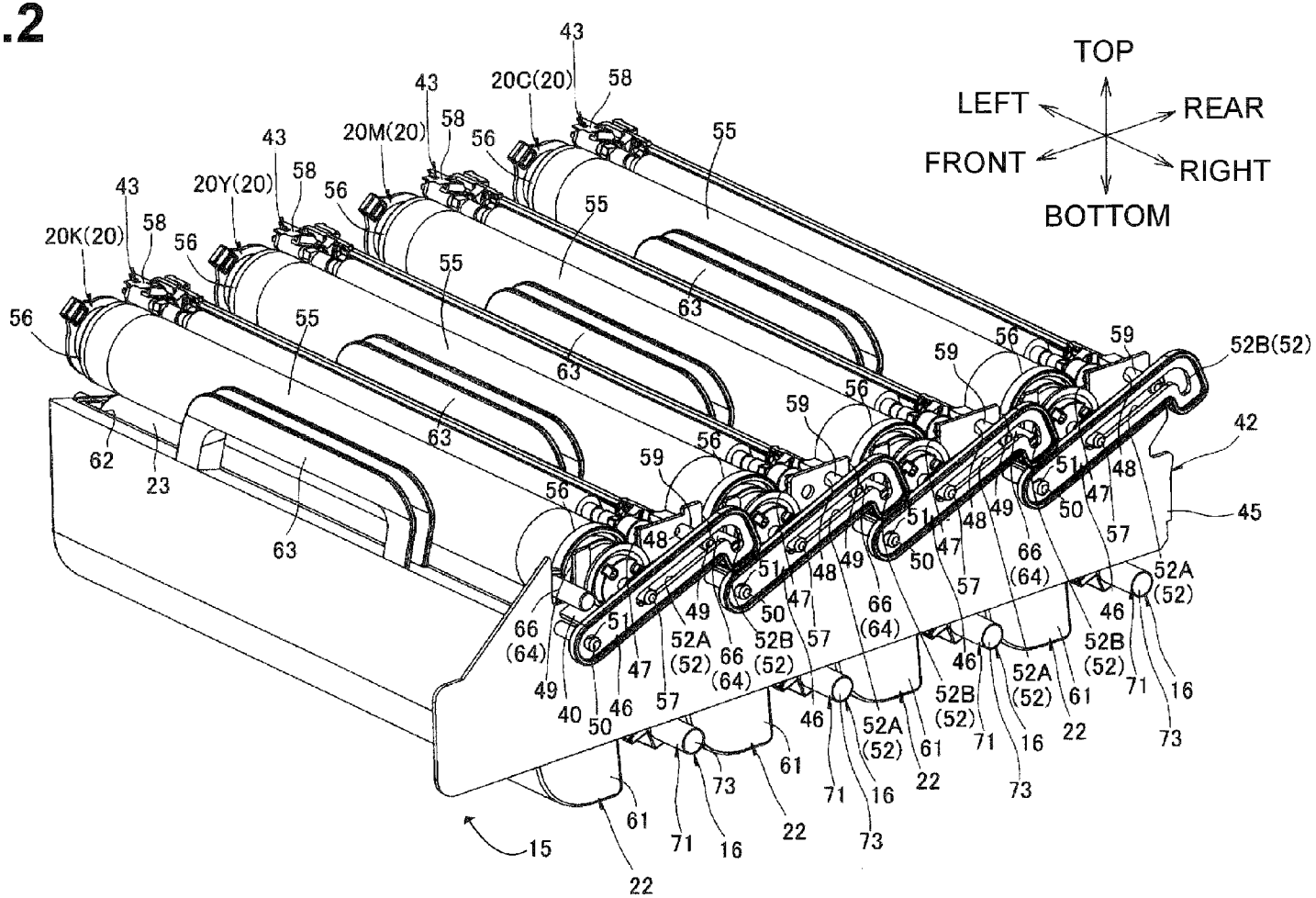
FIG. 2 is a perspective view, looking from the front and right, of a process unit illustrated in FIG. 1, from which a part of a drawer frame is removed.

The drawer frame 41 is shaped like an open-topped rectangular box, and includes support mechanisms 42 (only one is shown in FIG. 2), drum units 43, the developing cartridges 22, the LED units 16, and a belt cleaning unit 44.

The support mechanisms 42 are disposed facing each other inside the right and left sidewalls of the drawer frame 41.

Figure 4:
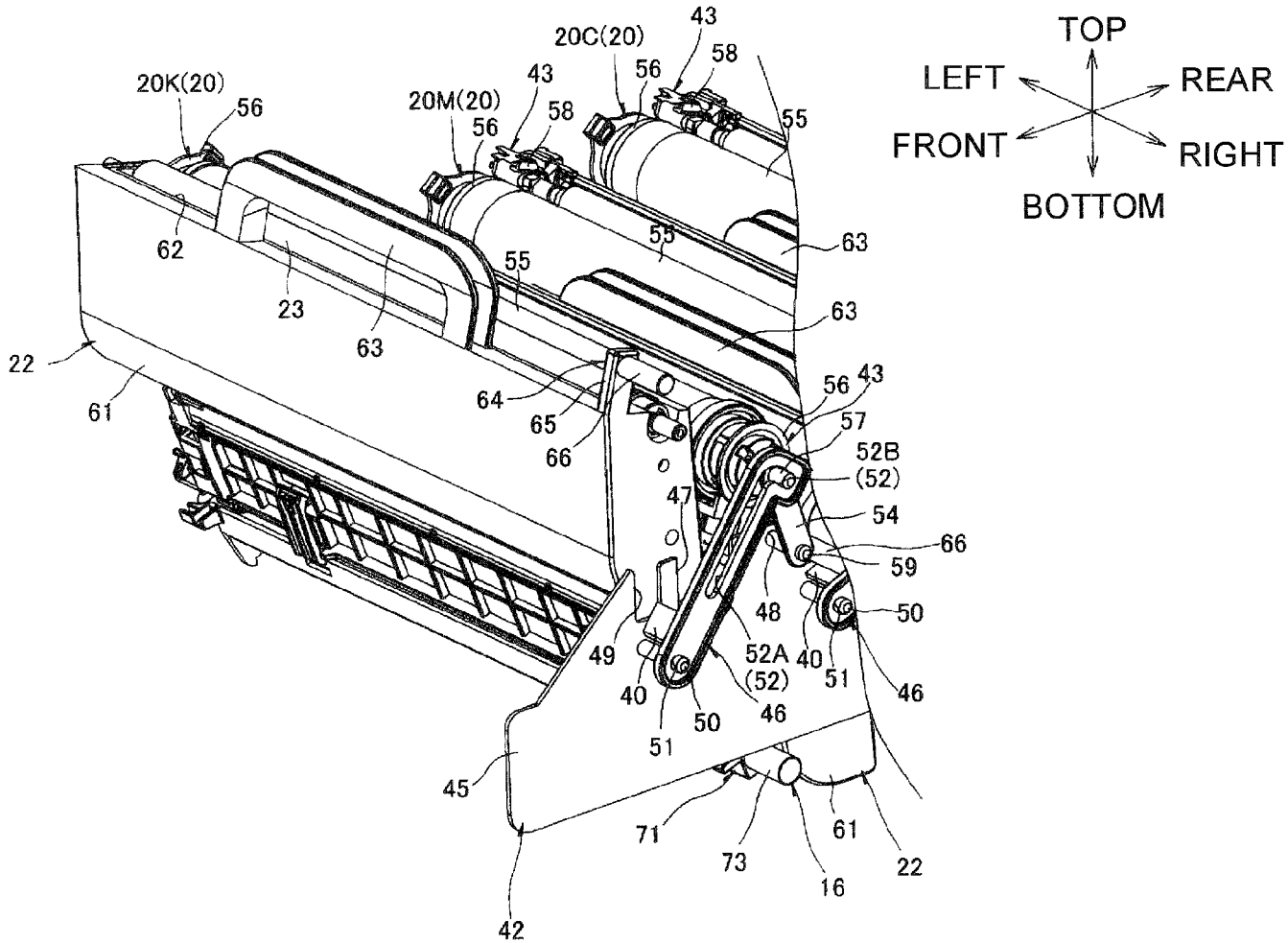
FIG. 4 is an enlarged perspective view in which the developing cartridge is being removed from the process unit.

As shown in FIG. 2, each support mechanism 42 includes a support plate 45 and four holding members 46. The support plate 45 is configured to support the drum units 43 and the developing cartridges 22. The holding members 46 are configured to hold the respective drum units 43 in their retracted positions (FIG. 4).

The support plate 45 is shaped like substantially a rectangle, extending in the front-rear direction. The support plate 45 has drum support grooves 47 for supporting the photosensitive drums 20, unit supporting holes 48 for supporting the drums units 43, and cartridge support grooves 49 for supporting the developing cartridges 22. The support plate 45 also includes support bosses 50 for supporting the holding members 46.

Four drum support grooves 47 are spaced apart from each other in the front-rear direction to correspond to the respective photosensitive drums 20. Each of the drum support grooves 47 is recessed downward from an upper end of the support plate 45 to have a U-like shape, which is open upward, in a side view. Each of the drum support grooves 47 has a width (a length in the front-rear direction) sized to receive a flange member 56 of the corresponding photosensitive drum 20.

Each of the unit support holes 48 is formed at the rear of a corresponding one of the drum support grooves 47 and at the upper end portion of the support plate 45. Each of the unit support holes 48 extends through the support plate 45 in the right-left direction and is shaped like substantially a circle in a side view. Each of the unit support holes 48 has a diameter sized to receive a unit support boss 59 of the corresponding drum unit 43.

Each of the cartridge support grooves 49 is formed in front of a corresponding one of the drum support grooves 47. Each of the cartridge support grooves 49 is recessed downward from the upper end of the support plate 45 to have a U-like shape, which is open upward, in a side view. Each of the cartridge support grooves 49 has a width (a length in the front-rear direction) sized to receive a cartridge support boss 66 of the corresponding developing cartridge 22.

Each of the support bosses 50 is disposed under a corresponding one of the cartridge support grooves 49, and is shaped like substantially a cylinder, protruding outward from the support plate 45 in the right-left direction.

Each of the holding members 46 is shaped like a letter L in a side view, and extends in the front-rear direction and is bent downward at its rear end. The holding members 46 are arranged in the front-rear direction to correspond to the respective photosensitive drums 20.

Each of the holding members 46 has a guide groove 52 for guiding a shaft 57 of a corresponding photosensitive drum 20, and an insertion hole 51 into which a corresponding support boss 50 of the support plate 45. The holding member 46 also includes a contact portion 40 to contact a cartridge support boss 66 of a corresponding developing cartridge 22.

The guide groove 52 is shaped like substantially a letter L, in a side view, to correspond to the shape of the holding member 46 in a rear half of the holding member 46. Specifically, the guide groove 52 has a straight portion 52A extending in the front-rear direction substantially straightly and a bend portion 52B which is bent downward continuously from a rear portion of the straight portion 52A.

The insertion hole 51 is formed in a front end portion of the holding member 46 so as to extend through the holding member 46 in the right-left direction, and shaped like substantially a circle in a side view.

The contact portion 40 is disposed slightly at the rear of the insertion hole 51 in the front end portion of the holding member 46, and is shaped like substantially a flat plate, extending inward in the right-left direction from an upper end portion of the holding member 46.

The holding members 46 are arranged on an outer side of the support plate 45 in the right-left direction. In each holding member 46, the holding member support boss 50 of the support plate 45 is inserted into the insertion hole 51 and screwed such that the holding member 46 is pivotable on the front end portion of the holding member 46.

Each drum unit 43 includes a unit frame 58 configured to integrally hold the photosensitive drum 20 and a scorotron charger 21 (FIG. 1).

The unit frame 58 is shaped like substantially a box, which extends in the right-left direction and is open toward the front side. The unit frame 58 includes unit support bosses 59 at an upper rear end portion thereof.

The unit support bosses 59 have substantially a cylinder shape, extending outward from right and left outer surfaces of the unit frame 58 in the right-left direction. Each unit support boss 59 has an outside diameter which is smaller than a diameter of the unit support hole 48.

The photosensitive drum 20 is rotatably supported in a front end portion of the unit frame 58. The photosensitive drum 20 includes a base tube 55, a pair of right and left flange members 56, and a shaft 57.

The base tube 55 is shaped like substantially a cylinder extending in the right-left direction. The base tube 55 is covered with a photosensitive layer.

The flange members 56 extend in the right-left direction and are substantially cylindrically shaped and their outer sides in the right-left direction are closed.

The flange members 56 are engaged in both end portions of the base tube 55 in the right-left direction such as to have a central axis coincident with a central axis of the base tube 55 and so as not to rotate relative to the base tube 55. The flange members 56 are rotatably supported by the unit frame 58.

The shaft 57 is substantially cylindrically shaped and extends in the right-left direction. The shaft 57 has a central axis coincident with the central axis of the base tube 55, and is inserted into each of the flange members 56 so as to protrude outward from each of the flange members 56 in the right-left direction and so as not to rotate relative to the flange members 56. The shaft 57 has an outside diameter, which is smaller than a width of the guide groove 52 of the holding member 46. The shaft 57 is coupled to the unit support boss 59 via a coupling member 54 (FIG. 4).

The scorotron charger 21 is supported in a rear end portion of the unit frame 58 (FIG. 1).

The unit support boss 59 of the unit frame 58 is inserted into the unit support hole 48 of the support plate 45 and screwed. The drum unit 43 is supported by the support plate 45 such that the drum unit 43 is configured to pivot around the unit support boss 59.

The shaft 57 of the photosensitive drum 20 is inserted into the guide groove 52 of the holding member 46.

Figure 5B:
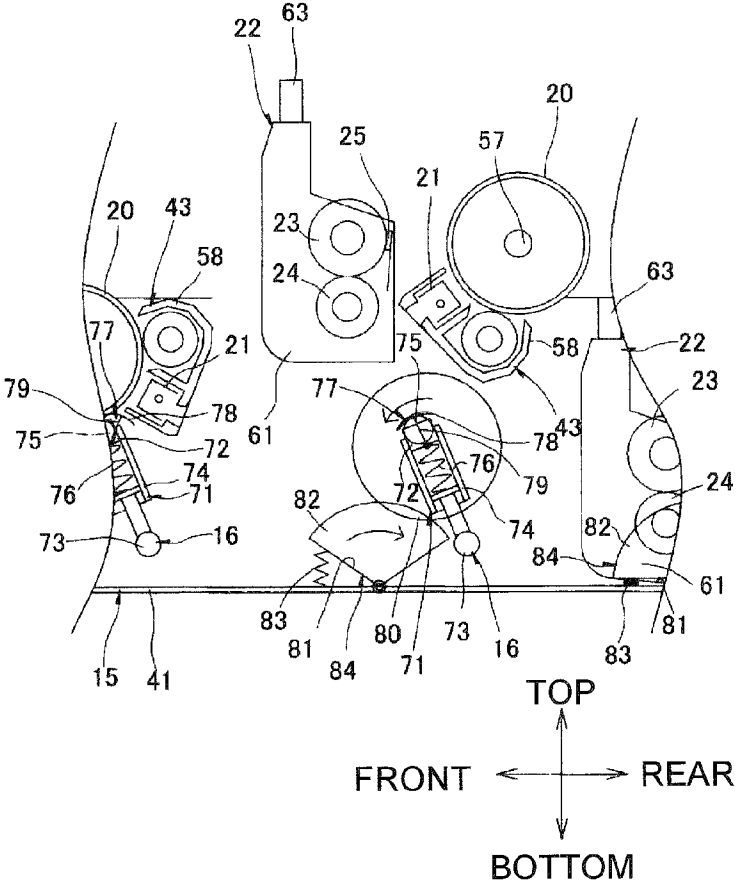
Figure 5A:
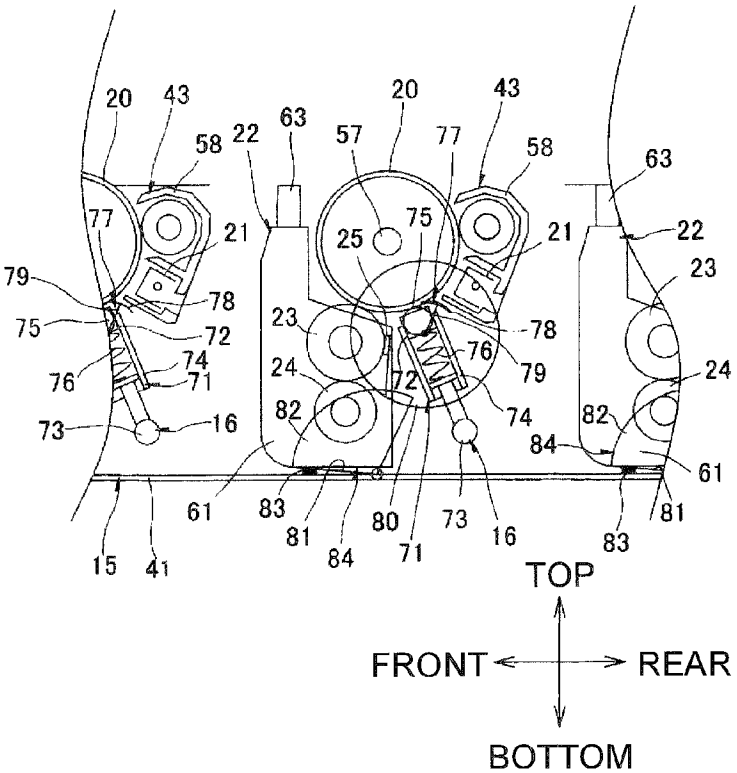
Figure 6A:
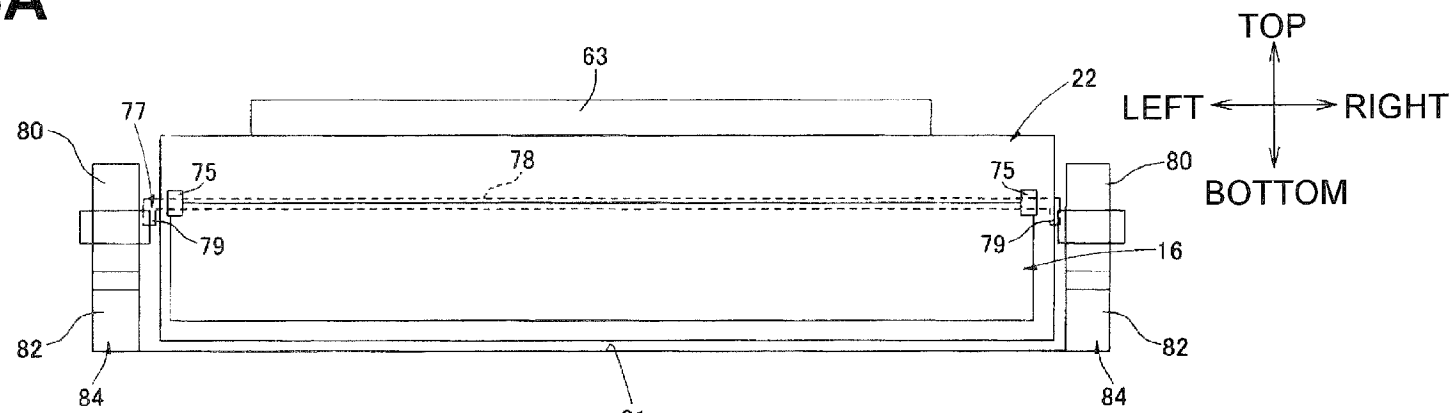
Figure 6B:
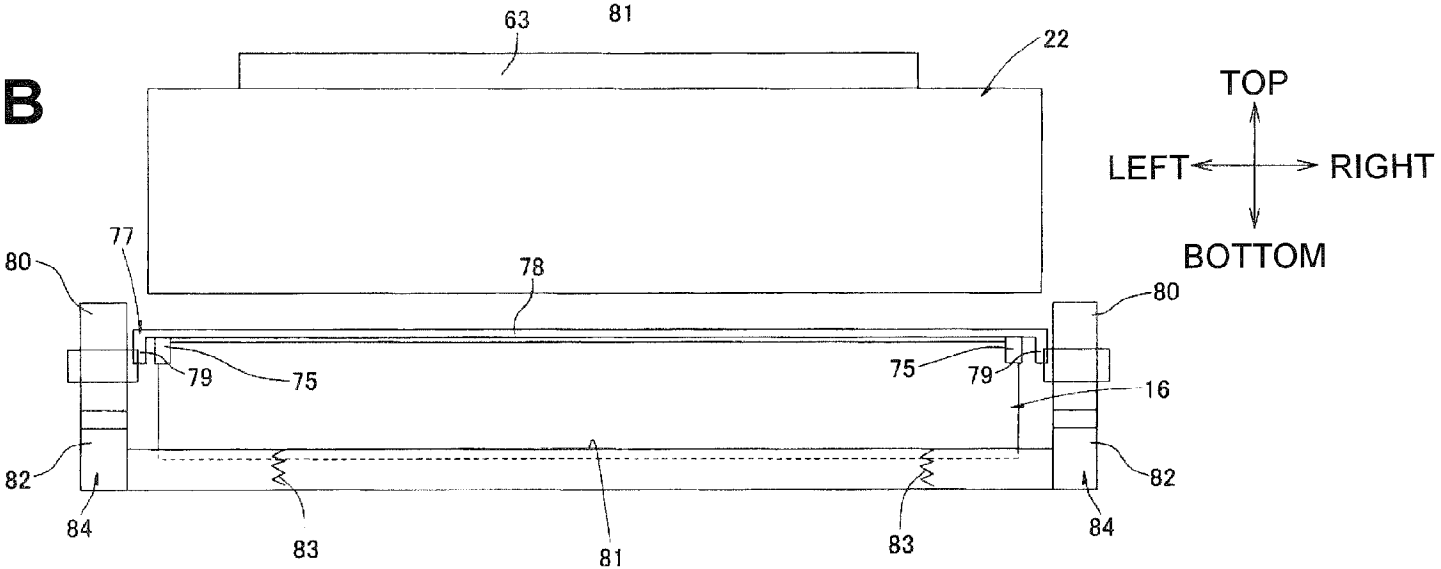

As shown in FIGS. 2 and 5A, when the developing cartridge 22 is attached to the drawer frame 41, the drum unit 43 is located in an image formation position where the flange member 56 is engaged in the drum support groove 47 of the support plate 45 and the photosensitive drum 20 faces the developing roller 23 from above. When the drum unit 43 is in the image formation position, an image can be formed on the photosensitive drum 20.

At this time, the holding member 46 is tilted in the front-rear direction, and the shaft 57 of the photosensitive drum 20 is inserted into a front end portion in the guide groove 52 of the holding member 46.

When the photosensitive drum 20 is pressed from below, the flange member 56 is disengaged from the drum support groove 47, and the drum unit 43 is pivoted around the unit support boss 59 clockwise in the right side view.

Concurrently, the holding member 46 is pressed upward by the shaft 57 of the photosensitive drum 20, pivoted around the holding member support boss 50 counterclockwise in the right side view, and inclined upwardly from the front side to the rear side.

At this time, the shaft 57 of the photosensitive drum 20 is guided along the straight portion 52A of the guide groove 52 of the holding member 46 and moved rearward in the guide groove 52. In other words, the straight portion 52A of the guide groove 52 functions as a guide portion configured to guide the drum unit 43 between the image formation position and the retracted position (FIG. 4).

As shown in FIG. 4, when the drum unit 43 is rotated until the shaft 57 reaches a rear end portion in the guide groove 52, the holding member 46 is raised such as to extend upward from the front side to the rear side.

When the holding member 46 is raised, the bend portion 52B of the guide groove 52 extends substantially in the front-rear direction, and the contact portion 40 overlaps a lower end portion of the cartridge support groove 49 when projected in the right-left direction.

When the drum unit 43 is further rotated, the shaft 57 is engaged in the bend portion 52B in the guide groove 52.

As shown in FIGS. 4 and 5B, the drum unit 43 is retracted upward and rearward from the image formation position where the photosensitive drum 20 is located above the developing roller 23, and thus the photosensitive drum 20 is located in the retracted position where the photosensitive drum 20 is retracted from the developing roller 23.

The drum unit 43 is stopped from rotating further counterclockwise when the shaft 57 contacts, from above, a wall defining a front side of the bend portion 52B. In other words, the bend portion 52B in the guide groove 52 functions as a stopper portion configured to engage and stop the photosensitive drum 20 in the retracted position.

To rotate the drum unit 43 from the retracted position to the image formation position, the holding member 46 is rotated clockwise in a right side view such that the shaft 57 is disengaged from the bend portion 52B and engaged in the straight portion 52A.

Then, the drum unit 43 is rotated counterclockwise in the right side view by its own weight, and located in the image formation position.

As shown in FIGS. 1 and 4, the developing cartridges 22 are detachably supported in the drawer frame 41. Each developing cartridge 22 includes a cartridge frame 61. The cartridge frame 61 supports a developing roller 23, a supply roller 24, and a layer thickness regulating blade 25, and is configured to store toner therein.

The cartridge frame 61 is shaped like substantially a box, extending in the right-left direction. The cartridge frame 61 has an opening 62, which is formed at a front-side upper end portion to have substantially a rectangular shape, in a plan view, extending in the right-left direction. The developing roller 23 is supported in the opening 62.

The cartridge frame 61 also includes a handle 63 and a cartridge support portion 64.

The handle 63 is disposed in a central portion of an upper end portion of the cartridge frame 61 in the right-left direction and shaped to have substantially an arc shape, protruding upward.

The cartridge support portion 64 includes an extending portion 65 and a cartridge support boss 66 as an example of an interference member.

The extending portion 65 extends upward from the upper end portion at an end of the cartridge frame 61 in the right-left direction.

The cartridge support boss 66 is shaped like substantially a cylinder, extending outward from an upper end portion of the extending portion 65 in the right-left direction. The cartridge support boss 66 has an outside diameter which is smaller than a width (a length in the front-rear direction) of the cartridge support groove 49.

As shown in FIGS. 5A and 5B, each LED unit 16 includes an LED array support member 71 extending between the right and left sidewalls of the drawer unit 41, a light emitting element array, e.g. an LED array 72, supported by the LED array support member 71, a covering member, e.g. an LED cover 77 covering the LED array 72, and a movable member 84 as an example of a cover operation mechanism configured to move the LED cover 77.

The LED array support member 71 includes a support beam 73 and an LED array storing portion 74.

The support beam 73 is shaped like substantially a cylinder extending in the right-left direction. The support beam 73 extends between both side plates of the drawer frame 41.

The LED array storing portion 74 is shaped like an open-topped rectangular box, and a bottom wall of the LED array storing portion 74 is coupled to the support beam 73. The LED array storing portion 74 has inside dimensions, in the front-rear direction and the right-left direction, substantially equal to or slightly greater than those of the LED array 72.

The LED array 72 integrally holds a number of LEDs arranged in the right-left direction. The LED array 72 has a length in the right-left direction, which is shorter than a length in the right-left direction of the photosensitive drum 20 and longer than a length in the right-left direction in a paper passing area on the photosensitive drum 20 where a sheet P contacts the photosensitive drum 20).

The LED array 72 includes LED positioning members 75, as an example of a protruding member, one by one at the right and left ends thereof. The LED positioning members 75 are configured to position the LED array 72 relative to the photosensitive drum 20.

The LED positioning members 75 are rollers having substantially a circular plate shape, and disposed to protrude slightly upward at the left and right ends of the LED array 72. The LED positioning members 75 contact the photosensitive drum 20 from below. Thus, the LED positioning members 75 are configured to position the LED array 72 at a distance (corresponding to a protrusion length of the LED positioning members 75) from the photosensitive drum 20 in face-to-face relationship with the photosensitive drum 20.

The LED array 72 is stored in an upper end portion of the LED array storing portion 74 such that the LED array 72 is movable relative to the LED array storing portion 74. A lower end portion of the LED array 72 is resiliently supported via a compression spring 76 by a bottom wall of the LED array storing portion 74.

Specifically, the compression spring 76 is connected at one end to the bottom wall of the LED array storing portion 74 and at the other end to the lower end portion of the LED array 72. Thus, the LED array 72 is resiliently supported via the compression spring 76 by the bottom wall of the LED array storing portion 74.

The LED cover 77 integrally includes a cover portion 78 that covers the LED array 72, support portions 79 at which the LED cover 77 is supported to the LED array support member 71, and drive gears 80 that apply a drive force to the LED cover 77.

The cover portion 78 has substantially a flat plate shape extending in the right-left direction in a plan view. The cover portion 78 is curved to have an upward arc shape when projected in the right-left direction.

The support portions 79 extend inside in a radial direction of the cover portion 78 from the left and right ends of the cover portion 78.

Each of the drive gears 80 has substantially a circular plate shape, having thickness in the right-left direction. The drive gear 80 has gear teeth around its peripheral surface. The drive gear 80 is disposed outside of each of the right and left support portions 79 so as not to rotate relative to the support portions 79. The drive gear 80 is located such that a center of rotation of the drive gear 80 overlaps a free end of each support portion 79 which is disposed inside in the radial direction of the cover portion 78.

The LED cover 77 is rotatably supported by the LED array support member 71 at the free ends (lower ends) of the support portions 79 such that the cover portion 78 is disposed upward.

The LED cover 77 is configured to move, e.g., pivot around the lower ends of the support portions 79, between an open position (or a retracted position shown in FIG. 5A) where the cover portion 78 is retracted from between the LED array 72 and the photosensitive drum 20 and a closed position (or a cover position shown in FIG. 5B) where the cover portion 78 covers the LED array 72 between the LED array 72 and the photosensitive drum 20. The LED cover 77 may be held in the open position at least when the LED unit 16 forms a latent image on the photosensitive drum 20.

As shown in FIGS. 5A, 5B, 6A and 6B, the movable member 84 includes an interference portion 81 as an example of an engaging portion, input gears 82, and compression springs 83. The interference portion 81 is configured to engage the lower end portion of the developing cartridge 22. The input gears 82 are configured to engage the drive gears 80 of the LED cover 77. The compression springs 83 are configured to urge the interference portion 81 upward.

The interference portion 81 is shaped like a flat plate, extends in the right and left direction (FIGS. 6A and 6B), and is disposed below the developing cartridge 22.

Each of the input gears 82 extends continuously from each of the right and left ends of the interference portion 81 (FIGS. 6A and 6B), and is shaped like a sector, in a side view, regarding a rear end portion of the interference portion 81 as the center. The input gear 82 extends rearward and upward to have substantially a 120-degree center angle (FIGS. 5A and 5B). The input gear 82 has gear teeth on a circumferential surface in the arc portion of the input gear 82 to engage the gear teeth of the drive gear 80.

The rear end of the interference portion 81 is supported at a bottom wall of the drawer frame 41 such that the movable member 84 is rotatable.

Thus, the movable member 84 is configured to move between a first position (FIG. 5A) where the interference portion 81 extends in the front-rear direction along the bottom wall of the drawer frame 41 and a second position (FIG. 5B) where the interference portion 81 is inclined upward toward the front side.

The movable member 84 is located in the first position as the interference portion 81 is pressed from above by the lower end portion of the developing cartridge 22 when the developing cartridge 22 is attached to the drawer frame 41. In other words, the lower end portion of the developing cartridge 22 functions as an engaging portion configured to engage the movable member 84 from above.

When the movable member 84 is in the first position, a rear end portion of the input gear 82 engages the drive gear 80 of the LED cover 77 located in the open position.

Each of the compression springs 83 is interposed between the interference portion 81 and the bottom wall of the drawer frame 41, and is connected at one end to the lower surface of the interference portion 81 and at the other end to the bottom wall of the drawer frame 41. Thus, the movable member 84 is urged clockwise in the right side view around the rear end portion of the interference portion 81.

The movable member 84 is urged clockwise in the right side view to move the LED cover 77 to the closed position.

As shown in FIG. 5A, when the LED cover 77 is in the open position, the movable member 84 is located in the first position, and the front end portion of the cover portion 78 is disposed at the rear of the upper end portion of the LED positioning member 75.

As shown in FIG. 5B, when the movable member 84 is rotated clockwise in the right side view by the urging force of the compression spring 83, a drive force having counterclockwise direction in the right side view is input to the drive gear 80 of the LED cover 77 via the input gear 82 of the movable member 84, and the drive gear 80 is rotated counterclockwise in the right side view.

Then, the counterclockwise drive force is input from drive gear 80 to the LED cover 77, and the LED cover 77 is rotated counterclockwise in the right side view from the open position.

When the LED cover 77 is rotated counterclockwise in the right side view from the open position, the front end portion of the cover portion 78 of the LED cover 77 is brought in contact with the upper end portion of the LED positioning member 75 from the rear.

When the LED cover 77 is further rotated, the cover portion 78 is moved frontward while pressing the circumferential surface of the LED positioning member 75 downward.

With this, the LED array 72 is retracted downward against the urging force of the compression spring 76, and the LED cover 77 is located in the closed position.

When the movable member 84 is rotated counterclockwise in the right side view against the urging force of the compression spring 83 under the situation where the movable member 84 is located in the second position and the LED cover 77 is located in the closed position (FIG. 5B), a clockwise drive force in the right side view is input via the input gear 82 of the movable member 84 to the drive gear 80 of the LED cover 77, and the drive gear 80 is rotated clockwise in the right side view.

Then, the clockwise drive force is input from the drive gear 80 to the LED cover 77 and the LED cover 77 is rotated clockwise from the closed position in the right side view.

When the LED cover 77 is rotated clockwise in the right side view from the closed position, the cover portion 78 is moved rearward.

When the front end portion of the cover portion 78 is retracted rearward from the upper end portion of the LED positioning member 75, the LED cover 77 is located in the open position, and the LED array 72 is moved upward by the urging force of the compression spring 76.

As shown in FIG. 1, the belt cleaning unit 44 includes a waste toner storing portion 91, a scrape roller 92, a scrape blade 93, and a belt cleaning roller 94.

The waste toner storing portion 91 is shaped like substantially a box having an opening 95 at its upper end portion.

The scrape roller 92 is disposed facing the opening 95 of the waste toner storing portion 91 from above.

The scrape blade 93 has the shape of substantially a flat plate extending in the front-rear direction, and a front end portion (base end portion) of the scrape blade 93 is fixed to a front end defining the opening 95 of the waste toner storing portion 91 such that a rear end portion (free end portion) thereof contacts the scrape roller 92 from below.

The belt cleaning roller 94 is rotatably supported at the upper end portion of the belt cleaning unit 44 such as to contact the scrape roller 92 from above.

The belt cleaning unit 44 is disposed such that the belt cleaning roller 94 contacts the lower side of the intermediate transfer belt 30 from below. The belt cleaning unit 44 is configured to cause the belt cleaning roller 94 to remove dirt, e.g. residual toner, from the intermediate transfer belt 30. The toner held by the belt cleaning roller 94 is transferred to the scrape roller 92, the toner transferred to the scrape roller 92 is scraped by the scrape blade 93, and then stored in the waste toner storing portion 91.

Figure 3:
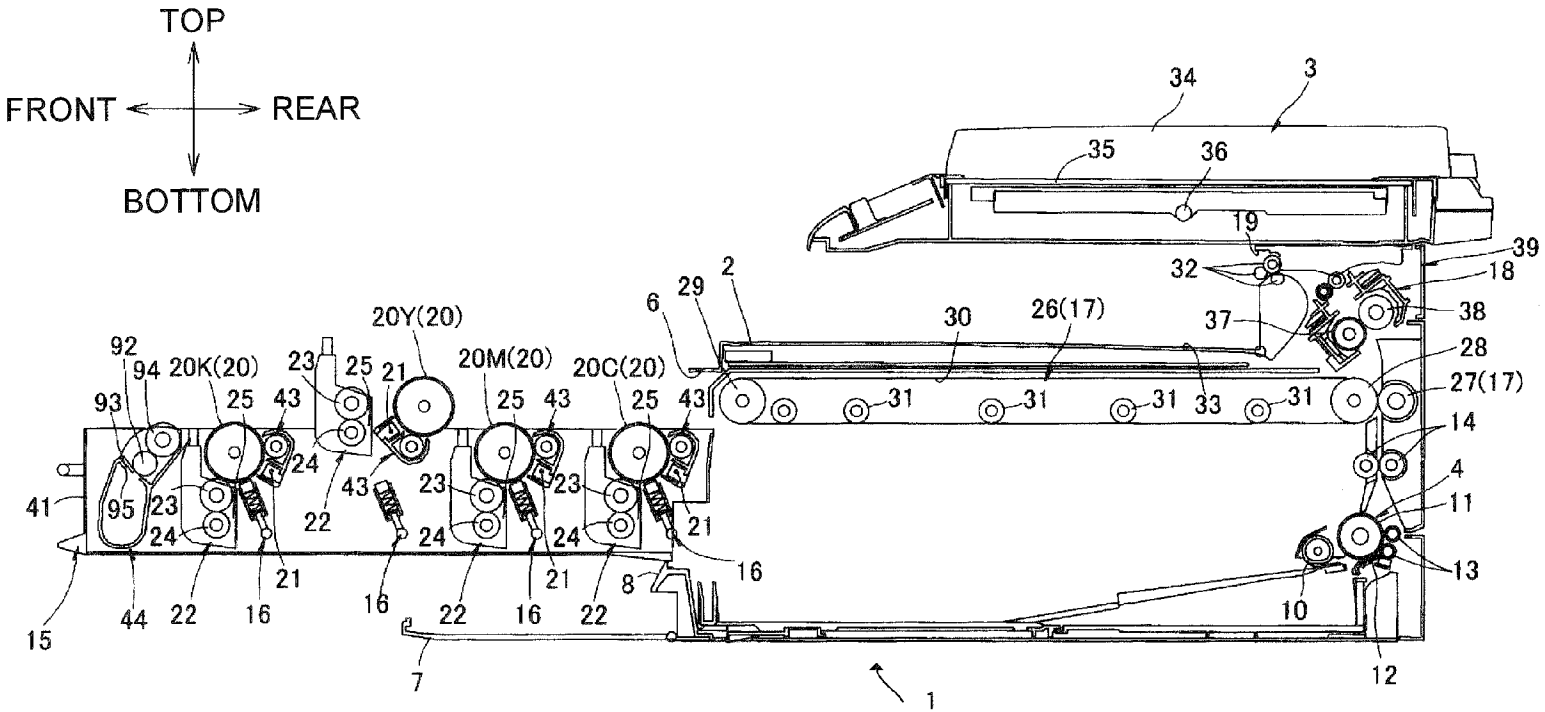
FIG. 3 illustrates the process unit illustrated in FIG. 1 is being pulled out from a casing, wherein a developing cartridge is being removed from the process unit.

When the developing cartridge 22 is removed from the casing 2, the front cover 7 is released, and the process unit 15 is pulled out frontward and located in the outside position as shown in FIG. 3.

The handle 63 of the developing cartridge 22 is held, and pulled upward from the drawer frame 41.

Along with upward movement of the developing cartridge 22, the developing roller 23 presses the photosensitive drum 20 from below.

When the photosensitive drum 20 is pressed from below, the drum unit 43 is rotated around the unit support boss 59 clockwise in the right side view as described above.

As shown in FIGS. 4, 5A and 5B, when the developing cartridge 22 is pulled further upward, the drum unit 43 is rotated further clockwise in the right side view, and is retracted upward and rearward from the position where the photosensitive drum 20 is located above the developing roller 23 and thus located in the retracted position. At this time, the shaft 57 is engaged in the bend portion 52B in the guide groove 52, and thus the drum unit 43 is stopped in the retracted position.

When the developing cartridge 22 is pulled further upward, the developing cartridge 22 is removed upward through a space formed when the drum 43 is retracted.

In this way, the developing cartridge 22 is removed from the casing 2.

As shown in FIG. 5B, when the developing cartridge 22 is removed from the casing 2, the pressing of the interference portion 81 by the lower end portion of the developing cartridge 22 is cancelled.

As described above, the movable member 84 is rotated clockwise in the right side view by the urging force of the compression spring 83, and the LED cover 77 is moved from the open position to the closed position.

When the developing cartridge 22 is attached to the casing 2, the process unit 15 is located in the outside position, such that the drum unit 43 is stopped in the retracted position. In this state, the handle 63 of the developing cartridge 22 is held such that the developing roller 23 is located rearward and exposed upward, to position the developing cartridge 22 above the drawer frame 41 in front of the drum unit 43.

The developing cartridge 22 is inserted into the drawer frame 41 from above such that the cartridge support boss 66 of the developing cartridge 22 is engaged in the cartridge support groove 49 of the drawer frame 41.

Then, the developing roller 23 of the developing cartridge 22 arrives in the drawer frame 41, and then the cartridge support boss 66 of the developing cartridge 22 is engaged in the cartridge support groove 49 of the drawer frame 41.

When the cartridge support boss 66 is engaged in lower end portion of the cartridge support groove 49, the cartridge support boss 66 contacts the contact portion 40 of the holding member 46.

As the cartridge support boss 66 contacts the contact portion 40, the holding member 46 is rotated about the holding member support boss 50 clockwise in the right side view.

The shaft 57 is disengaged from the bend portion 52B, and engaged in the straight portion 52A. Namely, engagement of the shaft 57 in the bend portion 52B is released.

Then, the drum unit 43 is rotated counterclockwise in the right side view from the retracted position by its own weight, and thus located in the image formation position.

In this way, the developing cartridge 15 is attached to the process unit 15.

When the developing cartridge 22 is attached to the process unit 15, as shown in FIG. 5A, the interference portion 81 of the movable member 84 is pressed from above by the lower end portion of the developing cartridge 22, and the movable member 84 is rotated counterclockwise in the right side view against the urging force of the compression spring 83.

Then, the LED cover 77 is rotated clockwise in the right side view from the closed position and located in the open position. At this time, the cover portion 78 is moved rearward such that it is retracted from a path along which the developing cartridge 22 is attached or removed.

When the LED cover 77 is located in the open position, the LED array 72 is moved upward by the urging force of the compression spring 76, and is brought in contact with the photosensitive drum 20 in the LED positioning member 75.

According to the printer 1, the drum unit 43 is configured to move between the image formation position where an image is formed on the photosensitive drum 20 and the retracted position where the photosensitive drum 20 is retracted from the developing roller 23, as shown in FIGS. 5A and 5B.

With this structure, as the drum unit 43 is moved to the retracted position, a path through which the developing cartridge 22 is attached and removed is opened. Thus, the developing cartridge 22 can be attached and removed through the path.

Thus, the developing cartridge 22 can be easily detachably attachable, only by rotating the drum unit 43 from the image formation position to the retracted position.

According to the printer 1, as shown in FIG. 4, the holding member 46 that holds each drum unit 43 in the retracted position is provided.

With the holding member 46, when the developing cartridge 22 is removed, the drum unit 43 can be held in the retracted position.

As a result, when the developing cartridge 22 is attached, there is no need to move the drum unit 43 to the retracted position, and thus the developing cartridge 22 can be easily attached.

According to the printer 1, as shown in FIG. 4, the guide groove 52 of the holding member 46 into which the shaft 57 of the drum unit 43 is inserted includes the straight portion 52A along which the drum unit 43 is guided between the image formation position and the retracted position and the bend portion 52B in which the drum unit 43 is stopped in the retracted position.

Thus, the shaft 57 of the drum unit 43 can be guided along the straight portion 52A and then smoothly stopped in the bend portion 52B.

As a result, the drum unit 43 can be moved from the image formation position to the retracted position and then smoothly stopped in the retracted position.

According to the printer 1, as shown in FIGS. 2 and 4, the developing cartridge 22 includes the cartridge support boss 66 that interferes with the holding member 46 and releases the engagement of the drum unit 43 in the bend portion 52B in the guide groove 52 while the developing cartridge 22 is attached to the casing 2.

While the developing cartridge 22 is removed from the casing 2, the developing roller 23 presses the drum unit 43 from below, and thus the drum unit 43 is moved from the image formation position to the retracted position. In addition, while the developing cartridge 22 is attached to the casing 2, the engagement of the drum unit 43 in the bend portion 52B of the guide groove 52 is released and thus the drum unit 43 is moved from the retracted position to the image formation position.

Thus, the drum unit 43 can be reliably moved to the retracted position by removing the developing cartridge 22, and reliably moved to the image formation position by attaching the developing cartridge 22.

According to the printer 1, as shown in FIGS. 1 and 3, the process unit 15 is provided which holds the drum units 43 and is configured to move along the front-rear direction between the inside position where the process unit 15 is disposed inside the casing 2 and outside position where the process unit 15 is pulled out outside the casing 2.

Thus, the printer 1 provides a front access design in which the process unit 15 is pulled frontward to detachably attach the developing cartridge 22 to the process unit 15.

As a result, even when the printer 1 is installed in a space limited vertically, the developing cartridge 22 can be detachably attached to the process unit 15 without great difficulty.

According to the printer 1, as shown in FIG. 1, the process unit 15 includes the belt cleaning unit 44 which cleans the intermediate transfer belt 30.

Thus, the need to increase the physical size of the printer 1 can be obviated compared with a case where a part for cleaning the intermediate transfer belt 30 is provided separately from the process unit 15.

According to the printer 1, as shown in FIG. 1, an intermediate transfer type is employed in which a toner image carried on each photosensitive drum 20 is primarily transferred to the intermediate transfer belt 30.

Thus, a toner image can be transferred onto a sheet P without the need to pass the sheet P between each photosensitive drum 20 and the belt unit 26, compared with a direct tandem type where a toner image carried on each photosensitive drum 20 is directly transferred to a sheet P.

As a result, a path along which the sheet P is fed can be simplified.

According to the printer 1, as shown in FIG. 1, the LED units 16 are provided which expose the photosensitive drums 20.

Thus, as the size of each LED unit 16 is small compared with a scanner which emits laser beams to expose the photosensitive drums 20, the need to increase the physical size of the printer 1 can be obviated.

According to the printer 1, as shown in FIG. 5A, when the developing cartridge 22 is attached to the casing 2 and at least when the LED unit 16 forms a latent image on the photosensitive drum 20, the cover operation mechanism is configured to hold the LED cover 77 in the open or retracted position where the LED cover 77 is retracted from between the photosensitive drum 20 and the LED array 72.

Thus, while the developing cartridge 22 is attached to the casing 2, the LED array 72 can be covered by the LED cover 77 except during image formation.

According to the printer 1, as shown in FIG. 5A, when the developing cartridge 22 is attached to the casing 2, the LED cover 77 is located in the open position where the LED cover 77 is retracted from between the photosensitive drum 20 and the LED array 72. In addition, as shown in FIG. 5B, when the developing cartridge 22 is removed from the casing 2, the LED cover 77 is located in the closed position where the LED cover 77 covers the LED array 72 between the photosensitive drum 20 and the LED array 72.

Thus, when the developing cartridge 22 is removed from the casing 2, the LED array 72 can be covered by the LED cover 77.

As a result, for example, the potential that the LED array 72 gets soiled by toner dropped from the photosensitive drum 20 can be minimized.

According to the printer 1, as shown in FIG. 5A, when the developing cartridge 22 is attached to the process unit 15, the interference portion 81 of the movable member 84 is pressed by the lower end portion of the developing cartridge 22. In addition, as shown in FIG. 5B, when the developing cartridge 22 is removed from the process unit 15, the interference portion 81 is released from being pressed by the lower end portion of the developing cartridge 22.

Thus, with a simple structure, attachment and removal of the developing cartridge 22 to and from the process unit 15 can be interlocked with the movement of the LED cover 77.

According to the printer 1, as shown in FIGS. 5A and 5B, the movable member 84 is urged such that the LED cover 77 is moved to the closed position.

Thus, when the developing cartridge 22 is removed from the process unit 15, the LED cover 77 can be reliably moved to the closed position.

According to the printer 1, as shown in FIGS. 5A and 5B, the movable member 84 includes the input gears 82 that engage the drive gears 80 of the LED cover 77, and the compression springs 83, and is urged by the urging force of the compression springs 83 such that the LED cover 77 is moved to the closed position.

With a simple structure, when the developing cartridge 22 is removed from the process unit 15, the LED cover 77 can be moved to the closed position.

According to the printer 1, as shown in FIG. 5A, the LED cover 77 is moved to the open position such that it is retracted from a path along which the developing cartridge 22 is attached or removed. In other words, the LED cover 77 located in the open position is opening the path.

Thus, the developing cartridge 22 can be attached to or removed from the process unit 15 without interference of the LED cover 77.

According to the printer 1, as shown in FIGS. 5A and 5B, the LED array 72 of the LED unit 16 is urged toward the photosensitive drum 20. When the LED cover 77 is in the open position, the LED positioning member 75 of the LED array 72 is brought into contact with the photosensitive drum 20, thereby the LED array 72 is disposed facing the photosensitive drum 20 at a specified distance. When the LED cover 77 is in the closed position, the LED cover 77 contacts the LED positioning member 75, thereby the LED array 72 is disposed facing the cover portion 78 of the LED cover 77 at a specified distance.

Thus, when the LED cover 77 is in the open position, the LED array 72 can be disposed facing the photosensitive drum 20 at a specified distance, and when the LED cover 77 is moved to the closed position, the LED array 72 can be disposed facing the cover portion 78 of the LED cover 77 at a specified distance.

As a result, with a simple structure, the LED array 72 can be positioned relative to the photosensitive drum 20, and the LED cover 77 can be prevented from interfering with the photosensitive drum 20.

According to the printer 1, as shown in FIGS. 1 and 5A, the LED array 72 is disposed under the photosensitive drum 20.

However, the LED cover 77 can minimize the potential that the LED array 72 gets soiled by toner dropped from the photosensitive drum 20.

According to the printer 1, as shown in FIG. 1, the four photosensitive drums 20 are spaced apart from each other in the front-rear direction perpendicular to an up and down direction (where the developing cartridge 22 is attached to or removed from the process unit 15).

Thus, the printer 1 is structured of a color printer having the photosensitive drums 20 corresponding to each color.

A second illustrative embodiment will be described with reference to FIGS. 7A and 7B. It is noted that elements similar to or identical with those shown and described in the first embodiment are designated by similar numerals, and thus the description thereof can be omitted for the sake of brevity.

According to the first embodiment, the LED cover 77 is provided with the drive gears 80, and the movable member 84 disposed under the developing cartridge 22 is provided with the input gears 82 that engage the drive gears 80. With the engagement of the drive gears 80 with the input gears 82, the LED cover 77 is moved to the open position along with the attachment of the developing cartridge 22, and moved to the closed position along with the removal of the developing cartridge 22.

Figure 7B:
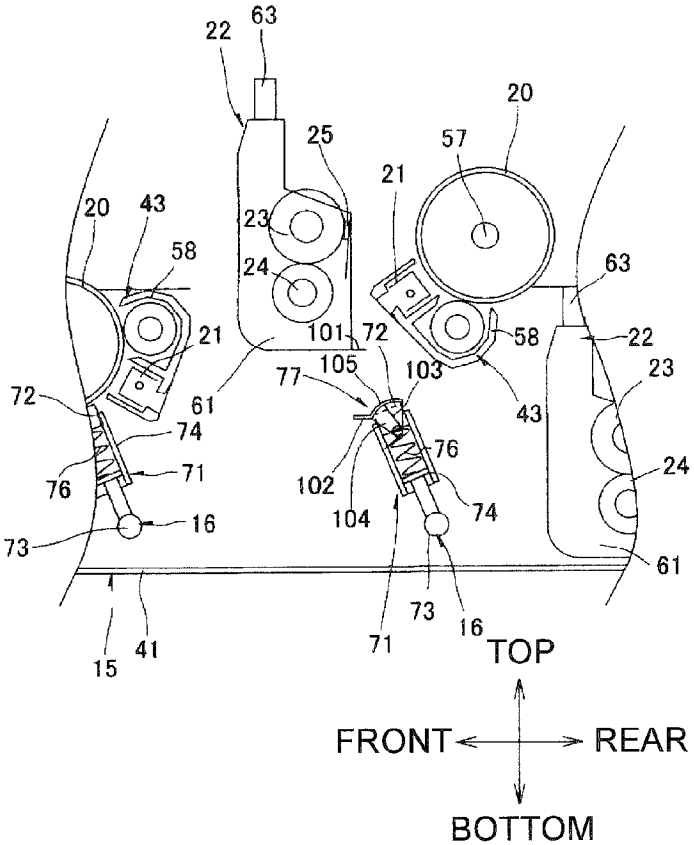
Figure 7A:
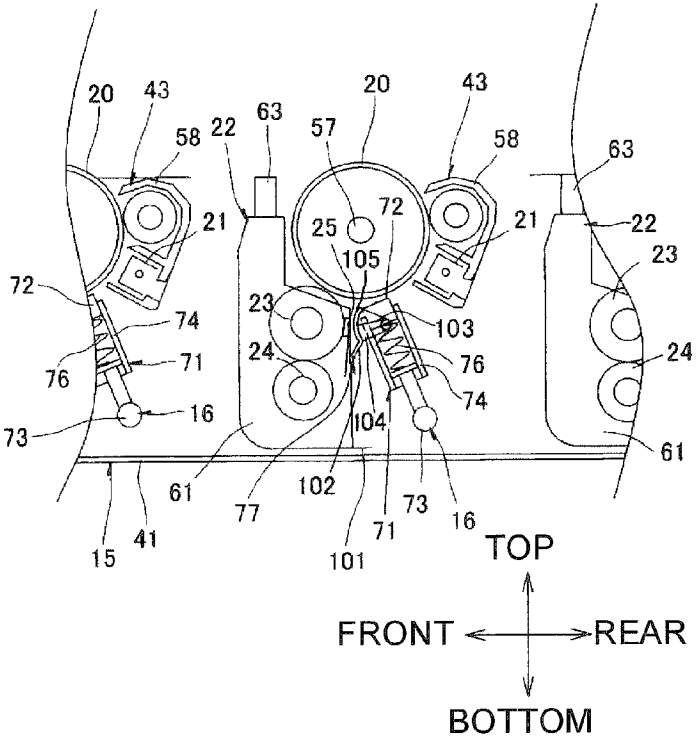

In the second embodiment, however, as shown in FIGS. 7A and 7B, the developing cartridge 22 includes, at its lower rear end portion, an engaging portion 101 protruding reward, as an example of a cover operation mechanism, and the LED cover 77 includes, at its front end portion, an engaging portion 102 protruding frontward, as an example of a cover operation mechanism. The LED cover 77 does not include the drive gears 80.

When the developing cartridge 22 is attached, the engaging portion 101 is brought in contact with the engaging portion 102 from above, and thereby the LED cover 77 is rotated counterclockwise in a right side view and located in the open position. When the developing cartridge 22 is removed, the engaging portion 101 is brought in contact with the engaging portion 102 from below, and thereby the LED cover 77 is rotated clockwise in the right side view and located in the closed position.

Specifically, in the second embodiment, the engaging portion 101 is shaped like substantially a flat plate protruding rearward from a lower rear end portion of the cartridge frame 61.

The LED cover 77 includes the engaging portion 102, a pair of right and left support plates 104 as an example of a cover operation mechanism, and a cover portion 105 extending between the support plates 104.

The support plates 104 are shaped like a sector in the right side view.

The cover portion 105 has substantially a flat plate shape in a plan view. The cover portion 105 is curved to correspond to an arc shape of the support plates 104 in a side view.

The engaging portion 102 extends frontward from the front end portion of the support plate 104 when the LED cover 77 is in the closed position (shown in FIG. 7B).

The LED cover 77 is supported by the LED array support member 71 such that the cover portion 105 is disposed upward and pivotable around a center angle portion (a lower end portion) of each support plate 104.

The LED cover 77 is rotated between an open position (or retracted position, FIG. 7A) where the cover portion 105 is retracted from between the LED array 72 and the photosensitive drum 20 and a closed position (or cover position, FIG. 7B) where the cover portion 105 covers the LED array 72 between the LED array 72 and the photosensitive drum 20.

The LED cover 77 is urged clockwise in the right side view by a coil spring 103 as an example of a cover operation mechanism. Specifically, the coil spring 103 is fixed at one end to the support plate 104 of the LED cover 77, and at the other end to the LED array storing portion 74.

When the developing cartridge 22 is attached, the LED cover 77 is located in the open position (FIG. 7A) where the cover portion 105 is retracted in front of the LED array 72 against an urging force of the coil spring 103. Then, the engaging portion 102 is brought in contact with a rear wall of the cartridge frame 61, and thereby the LED cover 77 is secured at the open position.

In the second embodiment, when the developing cartridge 22 is removed from the process unit 15, the engaging portion 101 is brought in contact with the engaging portion 102 from below, and thereby the LED cover 77 is rotated clockwise in the right side view and then located in the closed position.

When the developing cartridge 22 is attached to the process unit 15, the engaging portion 101 is brought in contact with the engaging portion 102 from above, and thereby the LED cover 77 is rotated counterclockwise in the right side view and then located in the open position.

According to the second embodiment, the LED cover 77 includes the engaging portion 102 and the support plates 104.

Thus, with a simple structure, attachment and removal of the developing cartridge 22 to and from the process unit 15 can be interlocked with the movement of the LED cover 77.

Even with the second embodiment, it is clear that effects similar to those brought about by the first embodiment can be appreciated.

A third illustrative embodiment will be described with reference to FIGS. 8 and 9.

It is noted that elements similar to or identical with those shown and described in the first embodiment are designated by similar numerals, and thus the description thereof can be omitted for the sake of brevity.

In the first embodiment described above, the arc-shaped handle 63 extending upward is disposed in the central portion of the upper end portion of each cartridge frame 61 in the right-left direction. In the third embodiment, the handles 63 are configured to move up and down. As shown in FIG. 8, when the process unit 15 is disposed inside the casing 2, the handles 63 are retracted inside or downward in the respective cartridge frames 61. As shown in FIG. 9, when the process unit 15 is pulled out from the casing 2, the handles 63 protrude outside or upward from the respective cartridges 61.

Figure 8:
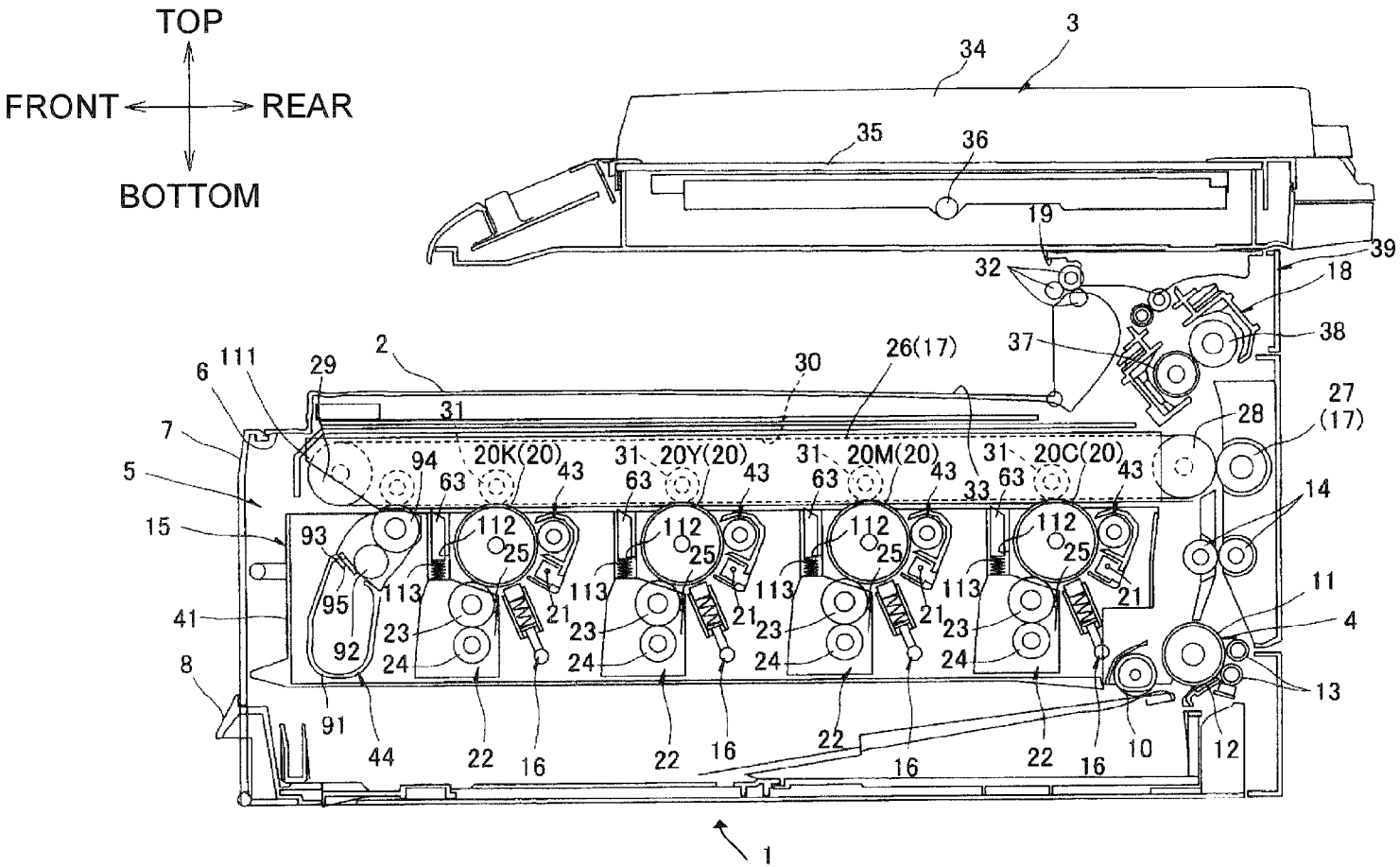
FIG. 8 illustrates a printer according to a third embodiment, in which the process unit is located inside the casing and handles of the developing cartridges are retracted downward.
Figure 9:
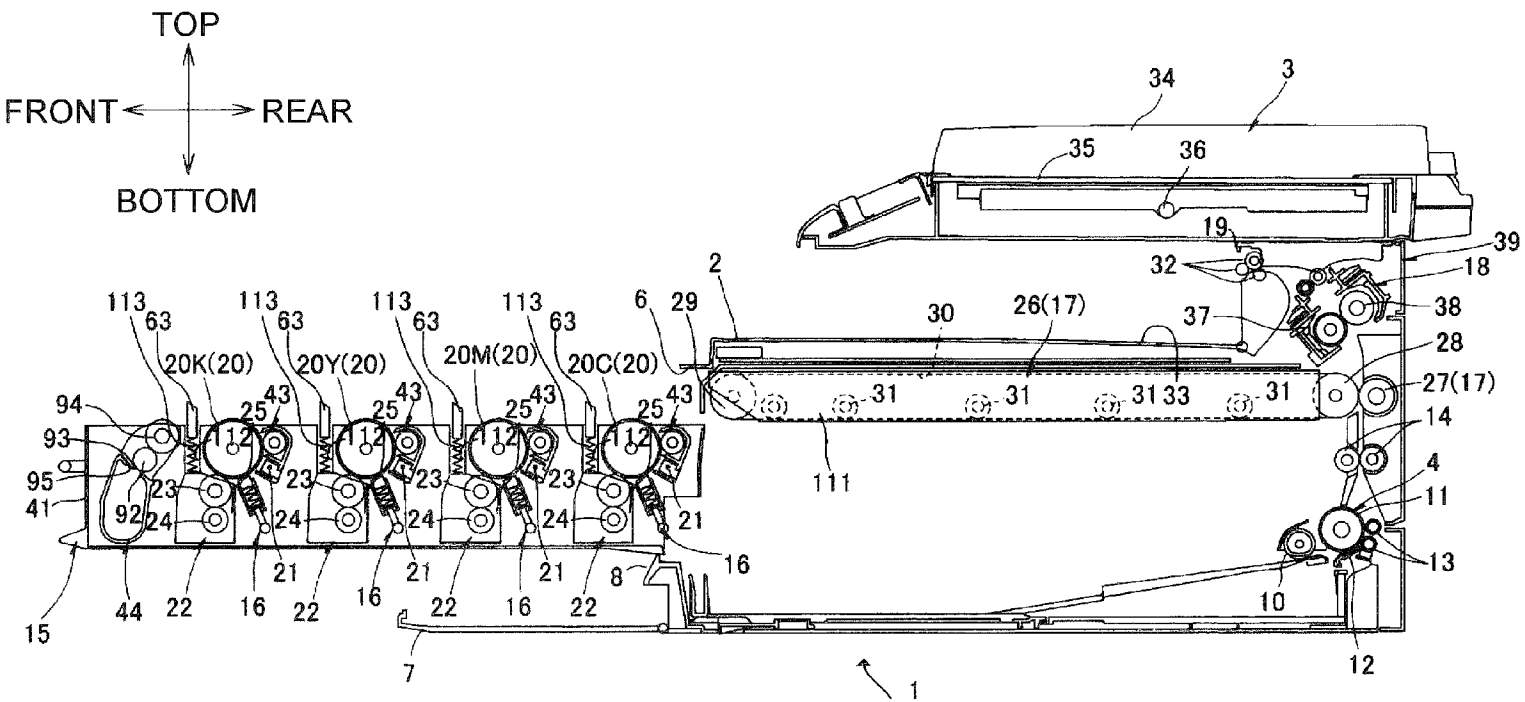
FIG. 9 illustrates that the process unit is pulled out from the casing and the handles of the developing cartridges protrude upward.

Specifically, in the third embodiment, as shown in FIGS. 8 and 9, the casing 2 includes inside a pair of rail members 111 as an example of a contact member, which are configured to press the handles 63 downward.

The rail members 111 are shaped like substantially a flat plate extending in the front-rear direction. The rail members 111 are disposed outside the base tubes 55 of the photosensitive drums 20 in the right-left direction, and are spaced apart from each other in the right-left direction to sandwich the belt unit 26 therebetween. The rail members 111 are fixed to an upper wall of the casing 2 at their upper end portions.

Each developing cartridge 22 includes a handle storing portion 112 in which the handle 63 is stored. The developing cartridge 22 includes a compression spring 113 as an example of an urging member that urges the handle 63 upward.

The handle storing portion 112 is defined at the upper end portion of the cartridge frame 61 to have the shape of substantially a rectangle extending vertically in a side view.

The handle 63 is stored in the handle storing portion 112 slidably in the up and down direction.

The coil spring 113 is connected at one end to a bottom wall of the handle storing portion 112 and at the other end to the lower end portion of the handle 63. Thus, the handle 63 is urged upward.

In the third embodiment, as shown in FIG. 8, when the process unit 15 is disposed inside the casing 2, an upper end portion of each handle 63 contacts a lower end portion of the rail members 111, and each handle 63 is pressed by the rail members 11 from above.

Thus, each handle 63 is retracted downward into the handle storing portion 112 of the cartridge frame 61 against the urging force of the compression spring 113 such that upper end portion of the handle 63 is disposed below the upper end portion of the photosensitive drum 20.

As shown in FIG. 9, when the process unit 15 is pulled out from the casing 2, the handles 63 are separated from the rail members 111 and released from being pressed by the rail members 111.

Each handle 63 is pressed upward from the handle storing portion 112 of the cartridge frame 61 by the urging force of the compression spring 113 such that the upper end portion of the handle 63 is located above the upper end portion of the photosensitive drum 20.

According to the third embodiment, as shown in FIGS. 8 and 9, the handles 63 are configured to be retracted below the upper end portions of the photosensitive drums 20 when the process unit 15 is disposed inside the casing 2, and to protrude above the upper end portions of the photosensitive drums 20 when the process unit 15 is pulled out from the casing 2.

Thus, when the process unit 15 is pulled out from the casing 2, the handles 63 protrude above the photosensitive drums 20, facilitating pickup and installation of the developing cartridge 22 relative to the process unit 15.

As a result, the developing cartridge 22 can be smoothly attached and removed.

According to the third embodiment, as shown in FIGS. 8 and 9, each developing cartridge 22 includes the compression spring 113 that urges the handle 63 upward, while the casing 2 includes the rail members 111 that contact the handle 63 from above when the process unit 15 is disposed inside the casing 2.

Thus, when the process unit 15 is inserted into the casing 2, each handle 63 is configured to contact the rail members 111 from below and withdraw downward against the urging force of the compression spring 113. When the process unit 15 is pulled out from the casing 2, each handle 63 is configured to protrude upward by the urging force of the compression spring 113.

As a result, with a simple structure, the vertical movement of the handles 63 can be interlocked with sliding movement of the process unit 15 relative to the casing 2.

In addition, even with the third embodiment, it is clear that effects similar to those brought about by the first embodiment can be appreciated.

A fourth illustrative embodiment will be described with reference to FIG. 10. It is noted that elements similar to or identical with those shown and described in the first embodiment are designated by similar numerals, and thus the description thereof can be omitted for the sake of brevity.

In the first embodiment described above, the printer 1 is designed with front access structure. By releasing the front cover 7, which is disposed in the front end portion of the casing 2, the process unit 15 is pulled out from the casing 2.

Figure 10:
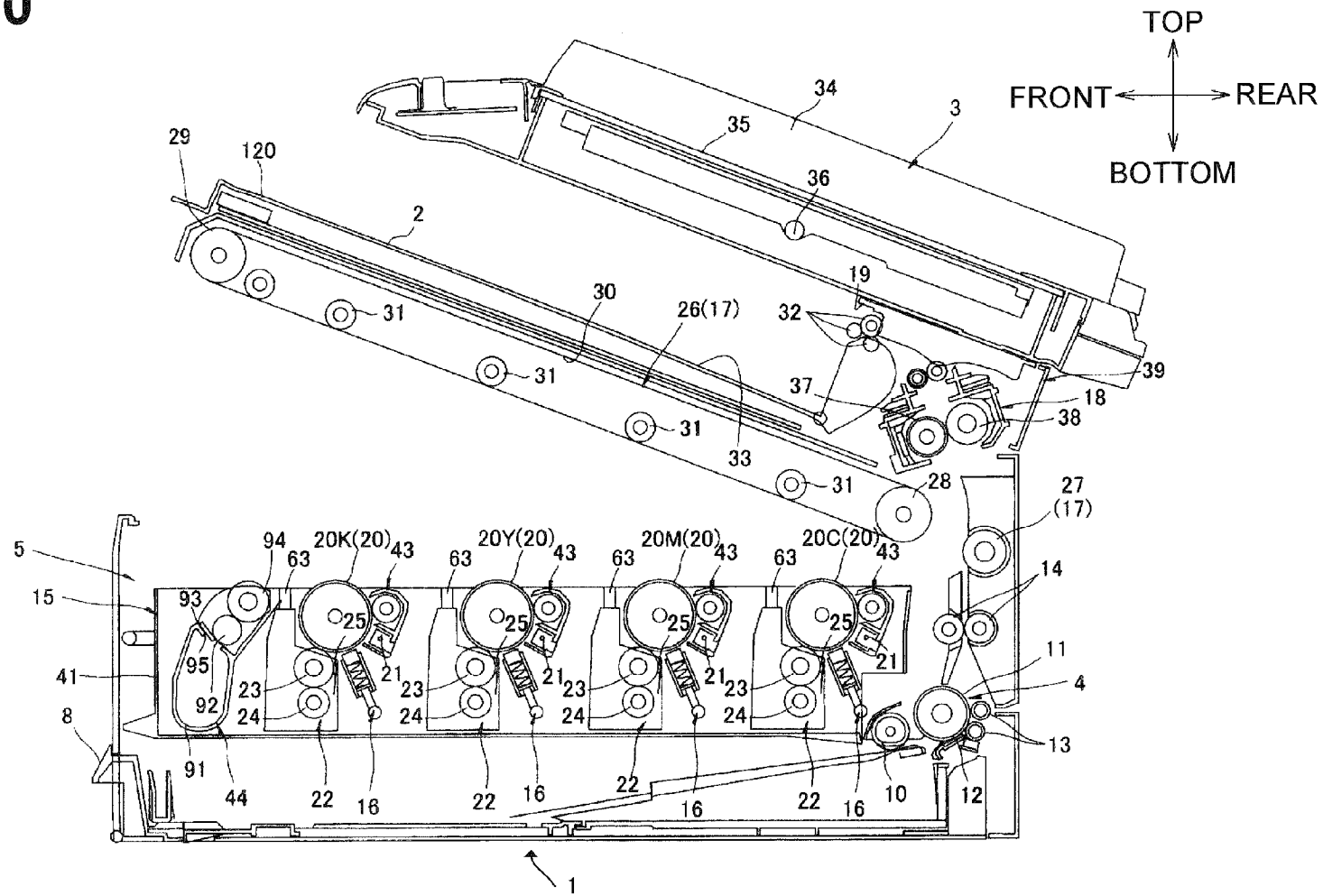
FIG. 10 illustrates a printer according to a fourth embodiment, in which a top cover is located in an open position.

In the fourth embodiment, as shown in FIG. 10, the casing 2 includes a top cover 120, as an example of a movable unit, at the upper end portion. By releasing the top cover 120, the developing cartridge 22 is attached to or removed from the casing 2.

Specifically, the top cover 120 is provided at the upper wall and an upper end portion of the rear wall of the casing 2.

The top cover 120 is configured to pivot about a middle portion of the rear wall of the casing 2 (a rear side of the fixing unit 18). The top cover 120 supports the belt unit 26 and the fixing unit 18 via a support mechanism, which is not shown.

The top cover 120 is pivoted along with the belt unit 26 and the fixing unit 18 such that the upper end portion of the casing 2 is fully released.

When the top cover 120 is released, the upper end portion of the process unit 15 is exposed from above and access to the developing cartridge 22 is available from above.

For attachment and removal of each developing cartridge 22 to and from the casing 2, the top cover 120 is pivoted upward such that the upper end portion of the casing 2 is released. Then, each developing cartridge 22 is attached to or removed from the casing 2 from the released upper end portion of the casing 2.

In addition, even with the fourth embodiment, it is clear that effects similar to those brought about by the first embodiment can be appreciated.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a casing;

a plurality of photosensitive members arranged along an arrangement direction; and a plurality of developing cartridges each including a developer carrying member, the developer carrying member being configured to supply developer to a corresponding one of the photosensitive members, wherein each photosensitive member is configured to move between an image formation position where an image is formed on the photosensitive member and a retracted position where the photosensitive member is retracted from the image formation position, wherein, when the photosensitive member is in the image formation position, the photosensitive member is configured to close a path through which a corresponding one of the developing cartridges is attached to and removed from the casing, wherein, when the photosensitive member is in the retracted position, the photosensitive member is configured to open the path, and wherein the photosensitive member is configured to at least one of:

move from the image formation position to the retracted position in response to the corresponding one of the developing cartridges being removed from the casing through the path; and move from the retracted position to the image formation position in response to the corresponding one of the developing cartridges being attached to the casing through the path.

2. The image forming apparatus according to claim 1, wherein the corresponding one of the developing cartridges is removed from the casing upward.

3. The image forming apparatus according to claim 1, wherein, when the corresponding one of the developing cartridges is removed from the casing, the photosensitive member remains in the retracted position.

4. The image forming apparatus according to claim 1, wherein the photosensitive member is configured to move from the image formation position to the retracted position in response to the corresponding one of the developing cartridges being removed from the casing through the path.

5. The image forming apparatus according to claim 1, wherein the photosensitive member is configured to move from the retracted position to the image formation position in response to the corresponding one of the developing cartridges being attached to the casing through the path.

6. The image forming apparatus according to claim 1, further comprising an endless belt extending in the arrangement direction and facing the photosensitive members on an opposite side from each of the developer carrying members, wherein the endless belt and the photosensitive members move relatively to each other between a first relative position where the endless belt and the photosensitive members are disposed proximate to each other and a second relative position where the endless belt and the photosensitive members are separated from each other, and wherein, when the endless belt and the photosensitive members are in the second relative position, each photosensitive member is configured to move between the image formation position and the retracted position.

7. The image forming apparatus according to claim 6, wherein each developing cartridge further includes a handle, wherein the handle is configured to be retracted inside a corresponding one of the developing cartridges when the endless belt and the photosensitive members are in the first relative position, and wherein the handle is configured to protrude outside from the corresponding one of the developing cartridges when the endless belt and the photosensitive members are in the second relative position.

8. The image forming apparatus according to claim 7, wherein each developing cartridge further includes an urging member configured to urge the handle in a direction where the handle protrudes, and wherein the casing includes a contact member configured to contact the handle such that the handle is retracted inside each developing cartridge against an urging force of the urging member when the endless belt and each photosensitive member are in the first relative position.

9. The image forming apparatus according to claim 6, further comprising a movable unit configured to move between an inside position where the movable unit is located inside the casing and an outside position where the movable unit is located outside the casing, wherein the movable unit is configured to dispose the endless belt and each photosensitive member in the first relative position when the movable unit is in the inside position, and wherein the movable unit is configured to dispose the endless belt and each photosensitive member in the second relative position when the movable unit is in the outside position.

10. The image forming apparatus according to claim 9, wherein the movable unit is configured to accommodate the photosensitive members and the developing cartridges therein.

11. The image forming apparatus according to claim 6, wherein the endless belt is configured to receive thereon a developer image carried on each photosensitive member and to transfer the developer image to a recording medium.

12. The image forming apparatus according to claim 1, further comprising a plurality of holding members, each holding member being configured to hold a corresponding one of the photosensitive members in the retracted position.

13. The image forming apparatus according to claim 12, wherein each holding member includes a guide portion and a stopper portion continuing from the guide portion, wherein the guide portion is configured to guide the corresponding one of the photosensitive members between the image formation position and the retracted position, and wherein the stopper portion is configured to engage and stop the corresponding one of the photosensitive members in the retracted position.

14. The image forming apparatus according to claim 13, wherein each developing cartridge further includes an interference portion, and the interference portion is configured to interfere with the holding member such that engagement of the corresponding one of the photosensitive members in the stopper portion is released when the developing cartridge is attached to the casing, wherein each photosensitive member is configured to move from the image formation position to the retracted position by being pressed by the corresponding one of the developing cartridges when removed from the casing, and wherein each photosensitive member is configured to move from the retracted position to the image formation position when the corresponding one of the developing cartridges is attached to the casing.

15. An image forming apparatus comprising:

a casing;

a photosensitive member; and a developing cartridge including a developer carrying member, the developer carrying member being configured to supply developer to the photosensitive member, wherein the photosensitive member is configured to move between an image formation position where an image is formed on the photosensitive member and a retracted position where the photosensitive member is retracted from the developer carrying member, wherein, when the photosensitive member is in the image formation position, the photosensitive member is configured to close a path through which the developing cartridge is attached to and removed from the casing, wherein, when the photosensitive member is in the retracted position, the photosensitive member is configured to open the path, and wherein the photosensitive member is configured to at least one of:

move from the image formation position to the retracted position in response to the developing cartridge being removed from the casing through the path; and move from the retracted position to the image formation position in response to the developing cartridge being attached to the casing through the path.

16. The image forming apparatus according to claim 15, when the developing cartridge is removed from the casing, the photosensitive member remains in the retracted position.

17. The image forming apparatus according to claim 15, wherein the photosensitive member is configured to move from the image formation position to the retracted position in response to the developing cartridge being removed from the casing through the path.

18. The image forming apparatus according to claim 15, wherein the photosensitive member is configured to move from the retracted position to the image formation position in response to the developing cartridge being attached to the casing through the path.

19. An image forming apparatus comprising:

a casing;

a plurality of photosensitive members arranged along an arrangement direction;

a plurality of holding members, one for each of the plurality of photosensitive members; and a plurality of developing cartridges each including a developer carrying member, the developer carrying member being configured to supply a developer to a corresponding one of the photosensitive members, wherein each photosensitive member is configured to move between an image formation position where an image is formed on the photosensitive member and a retracted position where the photosensitive member is retracted from the image formation position, wherein, when the photosensitive member is in the image formation position, the photosensitive member is configured to close a path through which a corresponding one of the developing cartridges is attached to and removed from the casing, wherein, when the photosensitive member is in the retracted position, the photosensitive member is configured to open the path, and wherein each of the plurality of holding members is configured to hold a corresponding one of the photosensitive members in the refracted position.

20. The image forming apparatus according to claim 19, wherein each holding member includes a guide portion comprising a groove including a straight portion and a bend portion, wherein the guide portion is configured to guide the corresponding one of the photosensitive members between the image formation position and the retracted position, wherein the corresponding one of the photosensitive members engages the straight portion of the groove when the photosensitive member is in the image formation position, and wherein the corresponding one of the photosensitive members engages the bend portion of the groove when the photosensitive member is in the retracted position.

* * * * *